US008482513B2

(12) United States Patent
Oke et al.

(10) Patent No.: US 8,482,513 B2
(45) Date of Patent: Jul. 9, 2013

(54) LIQUID CRYSTAL DISPLAY DEVICE HAVING A PLURALITY OF FIRST AND SECOND SCANNING LINES AND A PLURALITY OF FIRST AND SECOND VIDEO LINES

(75) Inventors: Ryutaro Oke, Chiba (JP); Kikuo Ono, Mobara (JP); Ikuko Mori, Mobara (JP); Masashi Baba, Chiba (JP); Yuya Sato, Mobara (JP)

(73) Assignees: Hitachi Displays, Ltd., Chiba (JP); Panasonic Liquid Crystal Display Co., Ltd., Hyogo-Ken (JP)

( * ) Notice: Subject to any disclaimer, the term of this patent is extended or adjusted under 35 U.S.C. 154(b) by 0 days.

(21) Appl. No.: 13/270,680

(22) Filed: Oct. 11, 2011

(65) Prior Publication Data

US 2012/0026214 A1 Feb. 2, 2012

Related U.S. Application Data

(62) Division of application No. 12/203,953, filed on Sep. 4, 2008, now abandoned.

(30) Foreign Application Priority Data

Sep. 5, 2007 (JP) ..... 2007-230465

(51) Int. Cl.
*G09G 3/36* (2006.01)

(52) U.S. Cl.
USPC ..... 345/102

(58) Field of Classification Search
USPC ..... 345/102
See application file for complete search history.

(56) References Cited

U.S. PATENT DOCUMENTS

| | | | | |
|---|---|---|---|---|
| 6,870,525 | B2 | 3/2005 | Kawabata et al. | |
| 7,898,519 | B2 | 3/2011 | Feng | |
| 2002/0067332 | A1 * | 6/2002 | Hirakata et al. | 345/102 |
| 2003/0043097 | A1 | 3/2003 | Shingai et al. | |
| 2004/0201564 | A1 * | 10/2004 | Sugino et al. | 345/101 |
| 2005/0078081 | A1 | 4/2005 | Oda et al. | |
| 2007/0091059 | A1 | 4/2007 | Kang | |
| 2007/0097288 | A1 | 5/2007 | Jang | |
| 2007/0152951 | A1 | 7/2007 | Ahn | |
| 2008/0001911 | A1 | 1/2008 | Kim | |

FOREIGN PATENT DOCUMENTS

| | | |
|---|---|---|
| JP | 2000-321551 | 11/2000 |
| JP | 2002-372956 | 12/2002 |
| JP | 2003-29236 | 1/2003 |
| JP | 2007-123233 | 5/2007 |
| WO | WO 2007/072599 | 6/2007 |

* cited by examiner

*Primary Examiner* — Chanh Nguyen
*Assistant Examiner* — Roy Rabindranath
(74) *Attorney, Agent, or Firm* — Antonelli, Terry, Stout & Kraus, LLP.

(57) ABSTRACT

A liquid crystal display device includes a liquid crystal display panel having first and second scanning lines, first and second video lines, a first scanning line driving circuit, a second scanning line driving circuit, at least one first video line driving circuit, at least one second video line driving circuit, a backlight having a number of light sources, and a light controlling circuit for controlling the turning on and off of the backlight. The first scanning lines are divided into M groups where M is an integer of 2 or more (M≧2), the second scanning lines are divided into N groups where N is an integer of 2 or more (N≧2), the region of the backlight which corresponds to the first scanning lines is divided into M regions, and the region which corresponds to the second scanning lines is divided into N regions.

5 Claims, 8 Drawing Sheets

(a)

(b)

(a)

(b)

LIQUID CRYSTAL DISPLAY DEVICE HAVING A PLURALITY OF FIRST AND SECOND SCANNING LINES AND A PLURALITY OF FIRST AND SECOND VIDEO LINES

CROSS REFERENCE TO RELATED APPLICATION

This application is a divisional application of U.S. application Ser. No. 12/203,953, filed Sep. 4, 2008, now abandoned the contents of which are incorporated herein by reference.

The present application claims priority from Japanese application JP2007-230465 filed on Sep. 5, 2007, the content of which is hereby incorporated by reference into this application.

BACKGROUND OF THE INVENTION (1) Field of the Invention

The present invention relates to a liquid crystal display device, and in particular, a display device which is appropriate for displaying videos.

(2) Related Art Statement

Display devices, particularly those for videos, can be roughly categorized into impulse response type display devices and hold response type display devices. Impulse response type display devices are display devices where the response of brightness lowers immediately after scanning, for example afterglow remains in cathode ray tubes, and cold response type display devices are such display devices as liquid crystal display devices which hold the brightness on the basis of display data until the next scan.

Hold response type display devices are characterized in that excellent display quality without flickering can be gained in the case of a still image but the outline of moving objects is blurry to the eye in the case of videos. That is to say, there is so-called video blurring, and thus, a problem arises, such that the display quality significantly lowers.

The cause of this video blurring is a so-called afterimage which remains on the retina, where the viewer interpolates the displayed image before and after the movement of the display image of which the brightness is held when moving the line of sight together with the moving object, and therefore, video blurring does not completely disappear, no matter how much the response rate of the display device is increased.

Methods for intermittently turning on the backlight in order to solve this problem are known. As one method for intermittently turning on the backlight, a method for driving scan-back light according to which the backlight is divided into a number of regions so that the divided regions can be turned on in sequence is known (see Patent Document 2 below).

Meanwhile, a method for simultaneously driving two screens according to which the liquid crystal display panel is divided in two and the respective liquid crystal display panels on the top and bottom are simultaneously driven in order to compensate for the lack of write-in information due to the high resolution of the liquid crystal display panel, or in order to drive the liquid crystal display panel as fast as 120 Hz (see Patent Document 1 below).

Here, the following prior art documents relate to the present invention.

(Patent Document 1) Japanese Unexamined Patent Publication 2002-372956 (Corresponding U.S. Application US2003/0043097 A1)

(Patent Document 2) Japanese Unexamined Patent Publication 2007-123233 (Corresponding U.S. Application US2007/0097288 A1)

SUMMARY OF THE INVENTION

Problem to Be Solved by the Invention

As described above, a method for driving scan-back light and a method for simultaneously driving two screens are described in Patent Documents 1 and 2, respectively, as a method for driving a liquid crystal display device.

The respective patent documents described above, however, do not mention anything about the method for simultaneously driving two screens and the method for driving scan-back light being used simultaneously as one method for driving a liquid crystal display device. If a conventional method for driving scan-back light is applied to a method for simultaneously driving two screens, the liquid crystal panel and the backlight are not driven in sync, because simultaneously driving two screen is not taken into consideration in conventional methods for driving scan-back light, and therefore, the video properties cannot be improved, and in addition, there is a risk that the display of still images may deteriorate.

The present invention is provided in order to solve the above described problems with the prior art, and an object of the present invention is to provide a liquid crystal display device which simultaneously uses a method for simultaneously driving two screens and a method for driving scan-back light.

The above described and other objects of the present invention, as well as novel features, will become clearer from the description of the present specification and the accompanying drawings.

Means for Solving Problem

The gist of typical inventions from among the inventions disclosed in the present application is briefly described below.

(1) A liquid crystal display device is provided with: a liquid crystal display panel having a number of first scanning lines and a number of second scanning lines; a first scanning line driving circuit for supplying a scanning voltage to the above described number of first scanning lines; a second scanning line driving circuit for supplying a scanning voltage to the above described number of second scanning lines; a backlight having a number of light sources; and a light controlling circuit for controlling the turning on and off of the above described backlight, and the above described number of first scanning lines are divided into M groups when M is an integer of 2 or more ($M \geqq 2$), the above described number of second scanning lines are divided into N groups when N is an integer of 2 or more ($N \geqq 2$), the region of the above described backlight which corresponds to the above described number of first scanning lines is divided into M regions and the region which corresponds to the above described number of second scanning lines is divided into N regions, and the above described light controlling circuit turns off the jth region of the above described backlight ($1 \leqq j \leqq M$) when the above described first scanning line driving circuit is supplying a selective scanning voltage to the first scanning lines within the jth group of the above described number of first scanning lines, turns on the jth region of the above described backlight when no selective scanning voltage is supplied to the first scanning lines within the jth group, turns off the kth region of the above described backlight ($1 \leqq k \leqq N$) when at least one of the above described second scanning line driving circuits supplies a selective scanning voltage to the second scanning lines within the kth group of the above described number of second scanning lines, and turns on the kth region of the above described backlight when no selective scanning voltage is supplied to the second scanning lines within the kth group.

(2) In the same structure as in (1), the above described liquid crystal display panel has: a number of first video lines which cross the above described number of first scanning lines; and a number of second video lines which cross the above described number of second scanning lines, and each of the above described number of first video lines and the above described number of second video lines is provided in such a manner as to be cut out between the above described number of first scanning lines and the above described number of second scanning lines.

(3) In the same structure as in (1) or (2), at least one first video line driving circuit for supplying a video voltage to the above described number of first video lines; and at least one second video line driving circuit for supplying a video voltage to the above described number of second video lines are provided, and the above described first video line driving circuit and the above described second video line driving circuit are provided along two sides of the above described liquid crystal display panel which face each other, and when the direction from the above described first video line driving circuit toward the above described second video line driving circuit is a first scanning direction and the direction from the above described second video line driving circuit toward the above described first video line driving circuit is a second scanning direction, the direction in which a selective scanning voltage is supplied from the above described first scanning line driving circuit to each scanning line of the above described number of first scanning lines in sequence, and the direction in which a selective scanning voltage is supplied from the above described second scanning line driving circuit to each scanning line of the above described number of second scanning lines in sequence are either the above described first scanning direction or the above described second scanning direction.

(4) In the same structure as in (1) or (2), at least one first video line driving circuit for supplying a video voltage to the above described number of first video lines; and at least one second video line driving circuit for supplying a video voltage to the above described number of second video lines are provided, and the above described first video line driving circuit and the above described second video line driving circuit are provided along two sides of the above described liquid crystal display panel which face each other, and when the direction from the above described first video line driving circuit toward the above described second video line driving circuit is a first scanning direction and the direction from the above described second video line driving circuit toward the above described first video line driving circuit is a second scanning direction, the direction in which a selective scanning voltage is supplied from the above described first scanning line driving circuit to each scanning line of the above described number of first scanning lines in sequence is the above described first scanning direction, and the direction in which a selective scanning voltage is supplied from the above described second scanning line driving circuit to each scanning line of the above described number of second scanning lines in sequence is the above described second scanning direction.

(5) In the same structure as in (1) or (2), at least one first video line driving circuit for supplying a video voltage to the above described number of first video lines; and at least one second video line driving circuit for supplying a video voltage to the above described number of second video lines are provided, and the above described first video line driving circuit and the above described second video line driving circuit are provided along two sides of the above described liquid crystal display panel which face each other, and when the direction from the above described first video line driving circuit toward the above described second video line driving circuit is a first scanning direction and the direction from the above described second video line driving circuit toward the above described first video line driving circuit is a second scanning direction, the direction in which a selective scanning voltage is supplied from the above described first scanning line driving circuit to each scanning line of the above described number of first scanning lines in sequence is the above described second scanning direction, and the direction in which a selective scanning voltage is supplied from the above described second scanning line driving circuit to each scanning line of the above described number of second scanning lines in sequence is the above described first scanning direction.

(6) In the same structure as in (4) or (5), the above described light controlling circuit makes the period during which the Mth region from among the above described M regions of the above described backlight and the first region from among the above described N regions which are adjacent to the above described Mth region are turned on shorter than the time during which the remaining regions are turned on.

(7) In the same structure as in any of (1) to (6), the jth region and the kth region of the above described backlight have at least one cold cathode fluorescent tube, and the above described light controlling circuit controls the turning on and off of the above described cold cathode fluorescent tube in the jth region and the kth region of the above described backlight.

(8) In the same structure as in any of (1) to (6), the jth region and the kth region of the above described backlight have at least one light emitting diode, and the above described light controlling circuit controls the turning on and off of the above described light emitting diode in the jth region and the kth region of the above described backlight.

Effects of the Invention

Typical effects of the inventions disclosed in the present specification are briefly described below.

According to the present invention, it becomes possible to provide a liquid crystal display device which simultaneously uses a method for simultaneously driving two screens and a method for driving scan-back light.

BRIEF DESCRIPTION OF THE DRAWINGS

FIG. 5(*b*) is a diagram showing another example of the method for driving a liquid crystal display device according to an embodiment of the present invention;

FIG. 5(*c*) is a diagram showing still another example of the method for driving a liquid crystal display device according to an embodiment of the present invention.

EXPLANATION OF SYMBOLS

Figure 1:
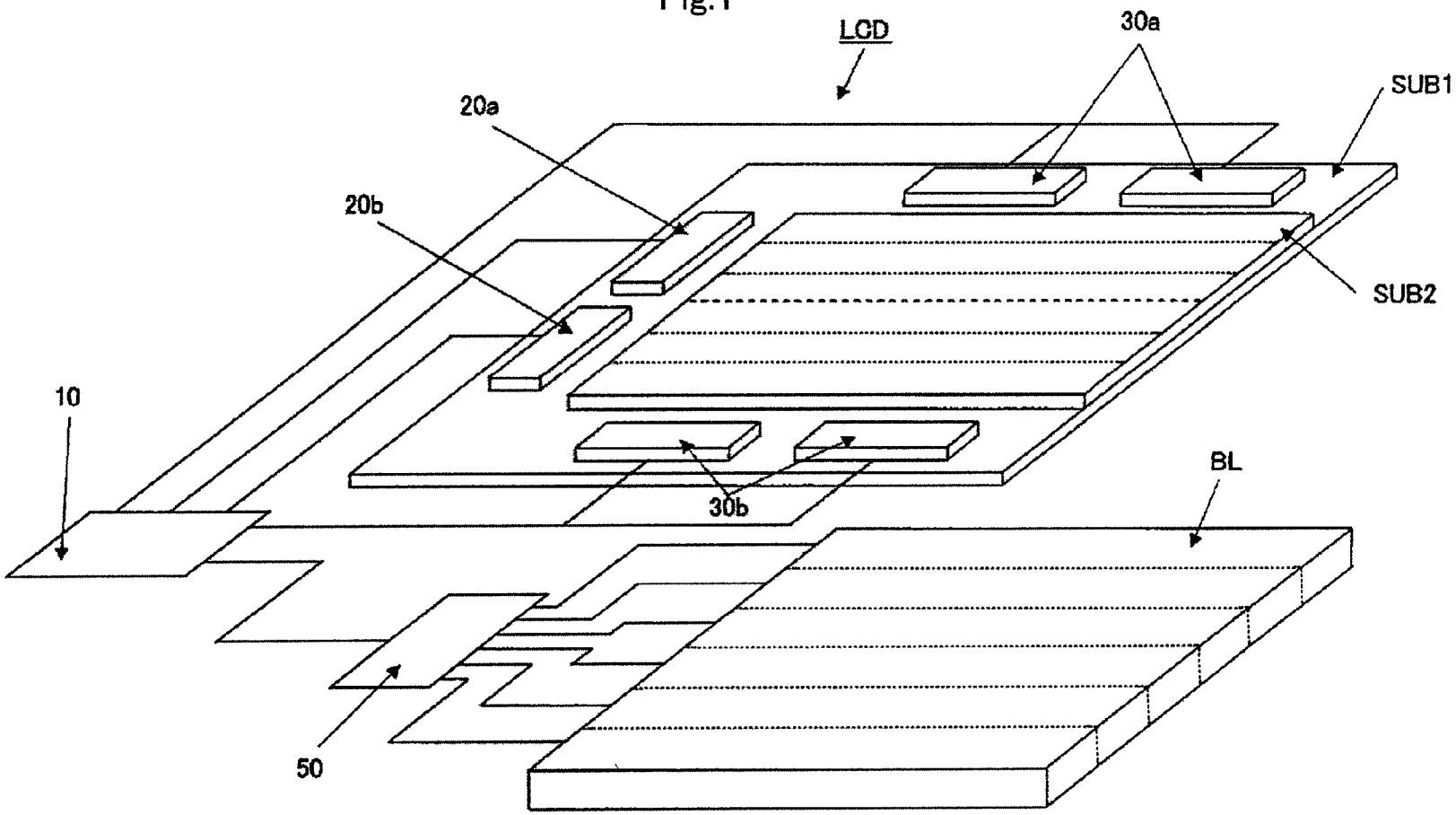
FIG. 1 is a block diagram schematically showing the configuration of the liquid crystal display device according to an embodiment of the present invention.

10 display controlling circuit (timing controller)
11 frame memory
20*a* first scanning line driving circuit
20*b* second scanning line driving circuit
30*a* first video line driving circuit
30*b* second video line driving circuit
41 inverter controlling circuit
42 inverter circuit
43 LED driver controlling circuit
44 LED driver
50 light controlling circuit
51 light guiding plate
52 optical sheets
53 frame
LCD liquid crystal display panel
SUB1 first substrate
SUB2 second substrate
BL directly-behind-the-display type backlight
DLa, DLb video lines
GL scanning line
PX pixel electrode
TFT thin film transistor
LC liquid crystal capacitor
Cadd holding capacitor
CFL cold cathode fluorescent tube
LED white light emitting diode
LEF column of light emitting diodes

DETAILED DESCRIPTION OF THE INVENTION

Best Mode for Carrying Out the Invention

In the following, the embodiments of the present invention are described in detail in reference to the drawings.

Here, the same symbols are attached to components having the same function in all of the drawings showing the embodiments, and the descriptions are not repeated.

FIG. 1 is a block diagram schematically showing the configuration of the liquid crystal display device according to an embodiment of the present invention. The liquid crystal display device in the present embodiment has a liquid crystal display panel (LCD) and a directly-behind-the-display type backlight (BL).

The liquid crystal display panel (LCD) has a first substrate (SUB1) and a second substrate (SUB2), thin film transistors, pixel electrodes and the like are formed on the first substrate (SUB1), and light blocking film, a color filter and the like are formed on the second substrate (SUB2). Here, the facing electrodes are formed on the first substrate (SUB1) in the case of a lateral electrical field type liquid crystal display panel (LCD), for example of an IPS type, and on the second substrate (SUB2) in the case of a longitudinal electrical field type liquid crystal display panel (LCD), for example of a VA type.

The liquid crystal display panel (LCD) is formed by pasting the first substrate (SUB1) and the second substrate (SUB2) together using a sealing material and injecting and sealing in liquid crystal between the first substrate (SUB1) and the second substrate (SUB2). In addition, polarizing plates are provided on the outside of the first substrate (SUB1) and the second substrate (SUB2).

Here, the present invention does not directly relate to the structure of the liquid crystal display panel (LCD), and therefore, the structure of the liquid crystal display panel (LCD) is not shown.

A first video line driving circuit (30*a*) and a second video line driving circuit (30*b*) are provided in the periphery of the first substrate (SUB1) on the two long sides which face each other. The first video line driving circuit (30*a*) and the second video line driving circuit (30*b*) are controlled and driven by a display controlling circuit (timing controller) 10.

In addition, a first scanning line driving circuit (20*a*) and a second scanning line driving circuit (20*b*) are provided in the periphery of the first substrate (SUB1) on tone short side. The first scanning line driving circuit (20*a*) and the second scanning line driving circuit (20*b*) are controlled and driven by the display controlling circuit (timing controller) 10.

Here, though a case where the first video line driving circuit (30*a*) and the second video line driving circuit (30*b*) are formed of two video line driving circuits (semiconductor chips) is shown in FIG. 1, the first video line driving circuit (30*a*) and the second video line driving circuit (30*b*) may be formed of one video line driving circuit or three or more video line driving circuits. In addition, the video line driving circuits may be provided on a flexible substrate connected to the first substrate (SUB1) instead of on the first substrate (SUB1).

In addition, though a case where the first scanning line driving circuit (20*a*) and the second scanning line driving circuit (20*b*) are formed of one scanning line driving circuit (semiconductor chip) is shown in FIG. 1, the first scanning line driving circuit (20*a*) and the second scanning line driving circuit (20*b*) may be formed of a number of scanning line driving circuits. In addition, the scanning line driving circuit may be provided on a flexible substrate connected to the first substrate (SUB1) instead of on the first substrate (SUB1).

Here, as described below, scanning lines are divided into six groups. In addition, the backlight (BL) is divided into six regions which correspond to the groups of scanning lines, and the six regions are individually controlled and driven by the light controlling circuit 50.

Figure 2:
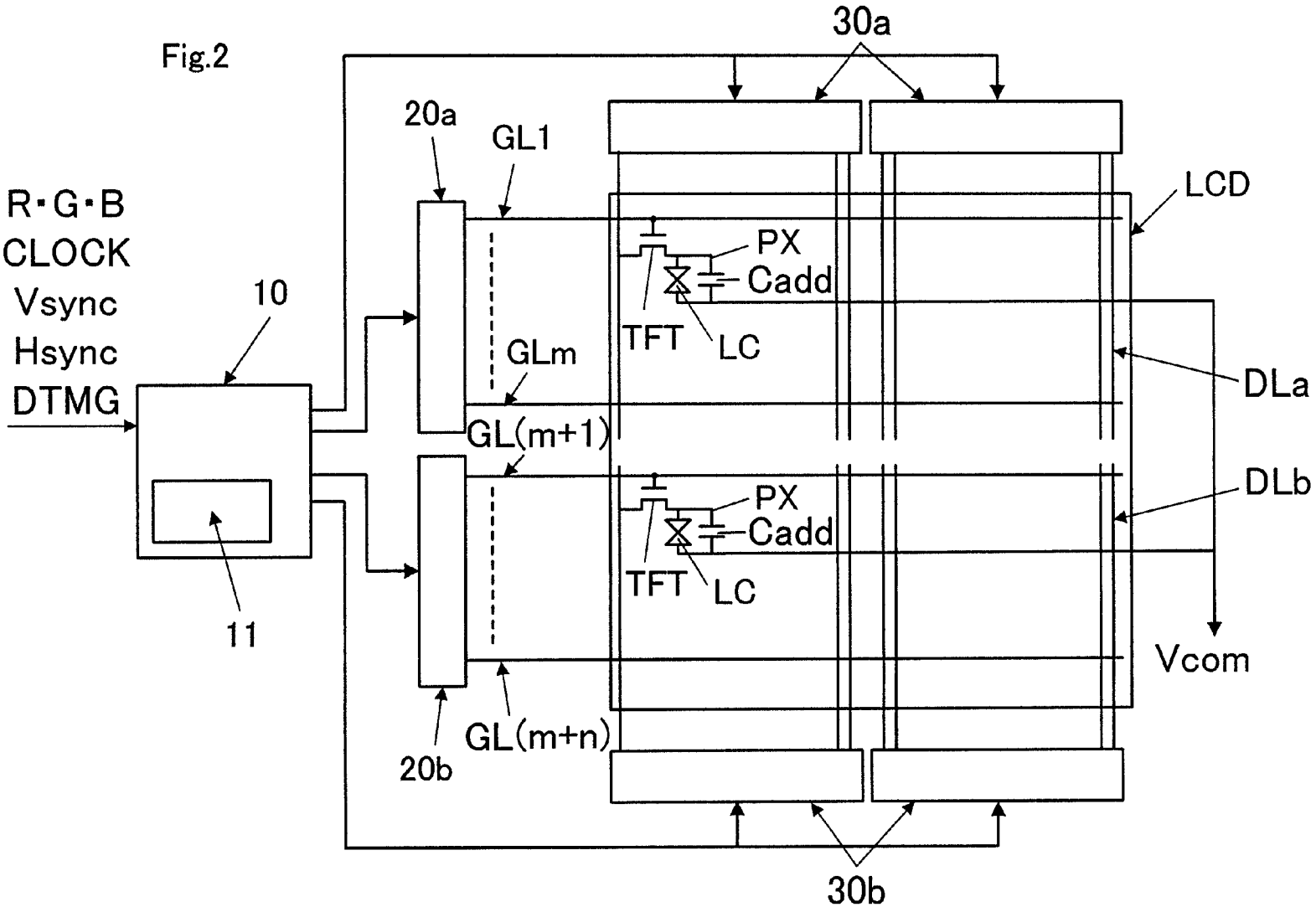
FIG. 2 is a block diagram showing the configuration of the liquid crystal display panel shown in FIG. 1.

FIG. 2 is a block diagram showing the configuration of the liquid crystal display panel (LCD) shown in FIG. 1.

The liquid crystal display panel (LCD) is divided in two, top and bottom, and first scanning lines (GL1 to GLm) are provided in the upper half and second scanning lines (GL(m+1) to GL(m+n)) are provided in the lower half. Here, m and n are integers of 2 or more.

Here, as described below, the first scanning lines (GL1 to GLm) and the second scanning lines (GL(m+1) to GL(m+n)) are each divided into three groups. That is to say, the scanning lines are divided into six groups.

In addition, first video lines (DLa) are provided in the upper half of the liquid crystal display panel (LCD) so as to cross the first scanning lines (GL1 to GLm), and furthermore, second video lines (DLb) are provided in the lower half of the liquid crystal display panel (LCD) so as to cross the second scanning lines (GL(m+1) to GL(m+n)).

The first video lines (DLa) are connected to the first video line driving circuit 30*a* and the second video lines (DLb) are connected to the second video line driving circuit 30*b*. The first scanning lines (GL1 to GLm) are connected to the first scanning line driving circuit 20*a*, and the second scanning line (GL(m+1) to GL(m+n)) are connected to the second scanning line driving circuit 20*b*.

In the liquid crystal display panel (LCD) shown in FIG. 2, the drain electrodes (or source electrodes) of the thin film transistors (TFT) in the respective pixels aligned in the direction of the columns are connected to the video lines (DLa, DLb), and the respective video lines (DLa, DLb) supply a gradation voltage corresponding to the display data to the pixel electrodes (PX) in the pixels aligned in the direction of the columns.

In addition, the gate electrodes of the thin film transistors (TFT) in the respective pixels aligned in the direction of the rows are respectively connected to the scanning lines (GL1 to GL(m+n)), and the respective scanning lines (GL1 to GL(m+n)) supply a selective scanning voltage to the gate electrodes of the thin film transistors (TFT) during one horizontal scan, and supply a non-selective scanning voltage at other times.

Here, in FIG. 2, LC is a liquid crystal capacitor which is equivalent to an element including the liquid crystal layer, and Cadd is a holding capacitor formed between a pixel electrode (PX) and a facing electrode to which a driving voltage Vcom is supplied.

The display controlling circuit 10 has a frame memory 11, and controls and drives the first video line driving circuit 30*a*, the second video line driving circuit 30*b*, the first scanning line driving circuit 20*a* and the second scanning line driving circuit 20*b* on the basis of the respective display controlling signals, including the dot clock (CLOCK), the vertical sync signal (Vsync), the horizontal sync signal (Hsync) and the display timing signal (DTMG), as well as data for display (R·G·B) sent from the main body side.

The first scanning line driving circuit 20*a* selects a first scanning line (GL1 to GLm), for example from the top to the bottom (in the order GL1→GL2 . . . ), and at the same time, the second scanning line driving circuit 20*b* selects a second scanning line (GL(m+1) to GL(m+n)), for example from the top to the bottom (in the order GL(m+1)→GL(m+2)). Meanwhile, during the period when a certain scanning line is selected, the first video line driving circuit 30*a* supplies a gradation voltage corresponding to the display data to the first video line (DLa) and the second video line driving circuit 30*b* supplies a gradation voltage corresponding to the display data to the second video line (DLb), so that the voltage is applied to the pixel electrode (PX).

That is to say, the first scanning line driving circuit 20*a* and the second scanning line driving circuit 20*b* apply a selective scanning voltage of a high level (hereinafter referred to as H level) to the gate electrodes of the thin film transistors (TFT) during one horizontal scanning period (1 H), so that all of the thin film transistors (TFT) connected to one scanning line are converted to an ON state, that is to say, a selected state, and thus, the gradation voltage outputted from the first video line driving circuit 30*a* and the second video line driving circuit 30*b* is inputted into the pixel electrodes (PX).

Conversely, in the case of a non-selective scanning voltage of a low level (hereinafter referred to as L level), all of the thin film transistors (TFT) connected to one scanning line are converted to an OFF state, that is to say, an unselected state.

As a result, the holding capacitor (Cstg) and the liquid crystal capacitor (LC) are charged, so as to control the liquid crystal molecules, and an image is displayed.

Figure 3:
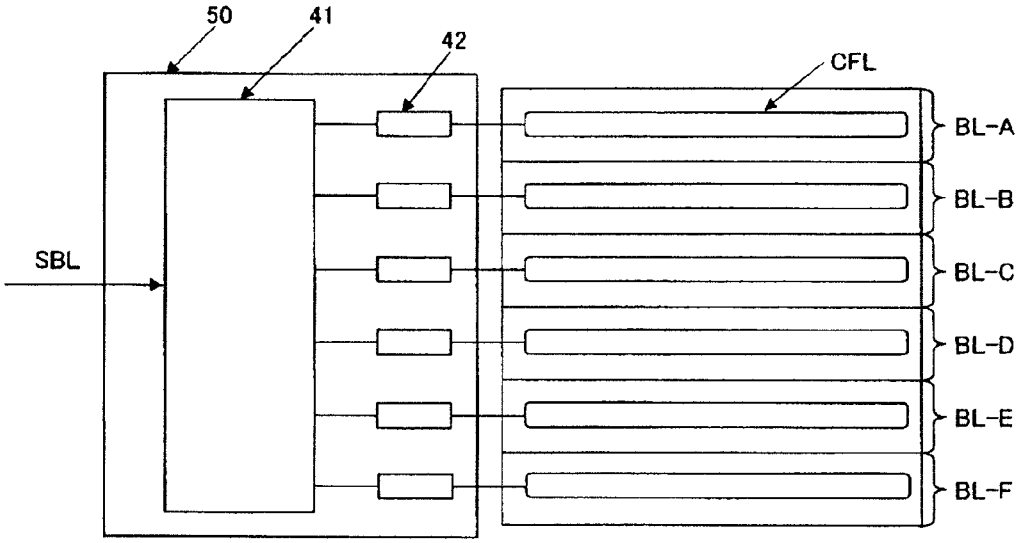
FIG. 3 is a block diagram showing the configuration of the backlight shown in FIG. 1.
Figure 3:
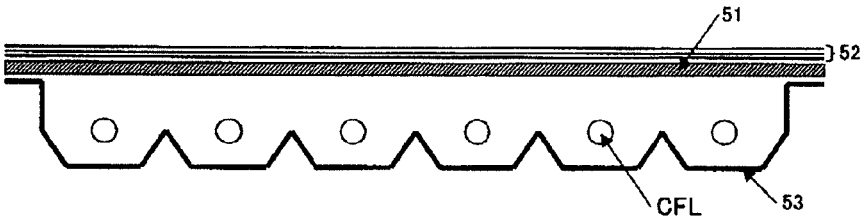

FIG. 3 is a block diagram showing the configuration of the backlight (BL) shown in FIG. 1.

As shown in FIG. 3(*a*), the light controlling circuit 50 is formed of an inverter controlling circuit 41 and an inverter circuit 42.

In addition, as shown in FIG. 3(*b*), the backlight (BL) are formed of six cold cathode fluorescent tubes (CFL), a frame 53 which also works as a reflective plate, a light guiding plate 51 provided on the liquid crystal display panel (LCD) side of the cold cathode fluorescent tubes (CFL), and optical sheets 52, including a lens sheet, a diffusion sheet and the like, placed on the light guiding plate 51.

As described above, the backlight (BL) is divided into six regions (BL-A to BL-F) and corresponds to the groups of the scanning lines on the liquid crystal display panel (LCD), and one cold cathode fluorescent tube (CFL) is provided in each of the six regions (DL-A to DL-F).

The inverter controlling circuit 41 individually controls and drives the cold cathode fluorescent tubes (CFL) in the six regions (BL-A to BL-F) on the basis of a light controlling signal (SBL) from the display controlling circuit 10.

Here, two or more cold cathode fluorescent tubes (CFL) may be provided in each of the six regions (BL-A to BL-F).

Figure 4A:
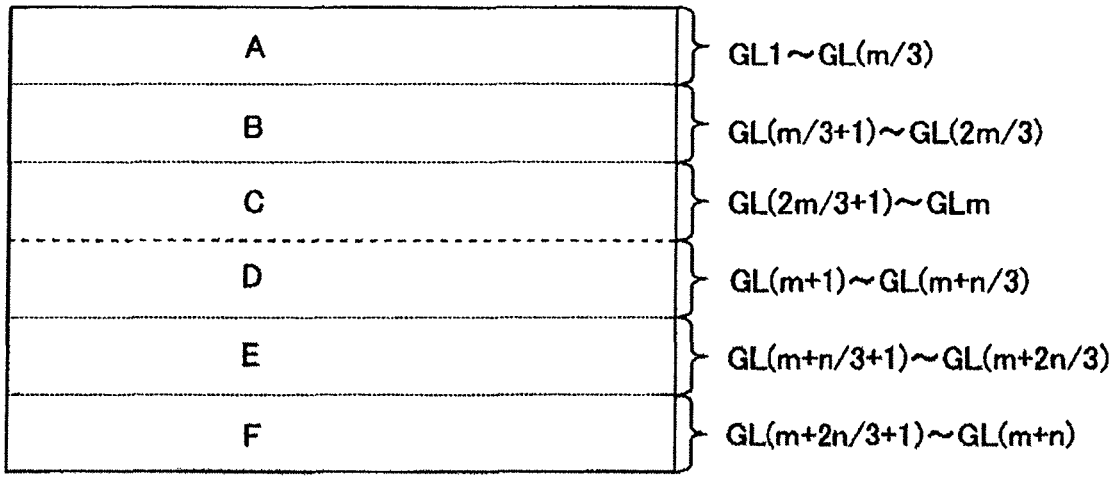
FIG. 4 is a diagram illustrating the liquid crystal display panel and the manner in which the backlight is grouped according to an embodiment of the present invention.
Figure 4B:
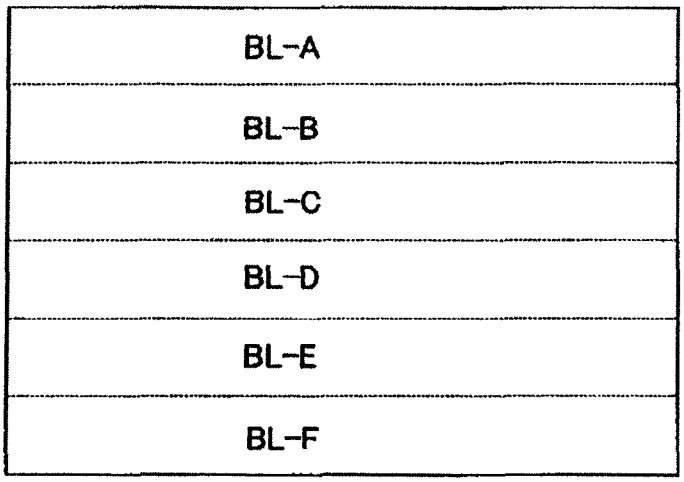

FIG. 4 is a diagram showing the liquid crystal display panel (LCD) and the manner in which the backlight (BL) is grouped according to the embodiment of the present invention.

As shown in FIG. 4, the liquid crystal display panel (LCD) is divided in two, top and bottom, and the first scanning lines (GL1 to GLm) in the top half are divided into three groups A, B and C, and the second scanning lines in the bottom half are divided into three groups D, E and F.

In FIG. 4, the group A is formed of the first to m/3th first scanning lines (GL1 to GL(m/3)), the group B is formed of the (m/3+1)th to (2m/3)th first scanning lines (GL(m/3+1) to GL(2m/3)), and the group C is formed of the (2m/3+1)th to mth first scanning lines (GL(2m/3+1) to GLm).

Furthermore, the group D is formed of the first to m/3th second scanning lines (GL(m+1) to GL(m+n/3)), the group E is formed of the (m+n/3+1)th to (m+2n/3)th second scanning lines (GL(m+n/3+1) to GL(m+2n/3)), and the group F is formed of the (m+2n/3+1)th to mth second scanning lines (GL(m+2n/3+1) to GLn).

In addition, the backlight (BL) is divided into six regions (BL-A to BL-F) and corresponds to the groups of scanning lines on the liquid crystal display panel (LCD), and as shown in FIG. 4, the region BL-A of the backlight (BL) corresponds to the group A, and likewise, the region BL-B of the backlight (BL) corresponds to the group B, the region BL-C of the backlight (BL) corresponds to the group C, the region BL-D of the backlight (BL) corresponds to the group D, the region BL-E of the backlight (BL) corresponds to the group E, and the region BL-F of the backlight (BL) corresponds to the group F.

Here, though FIG. 4 shows a case where the top half and the bottom half of the liquid crystal display panel (LCD) are each divided into three groups, the present invention is not limited to this, and any number of groups is possible, as long as there are two or more, and the number of groups may be different between the top half and the bottom half of the liquid crystal display panel (LCD), and furthermore, the number of scanning lines may be the same of different in each group.

Figure 5A:
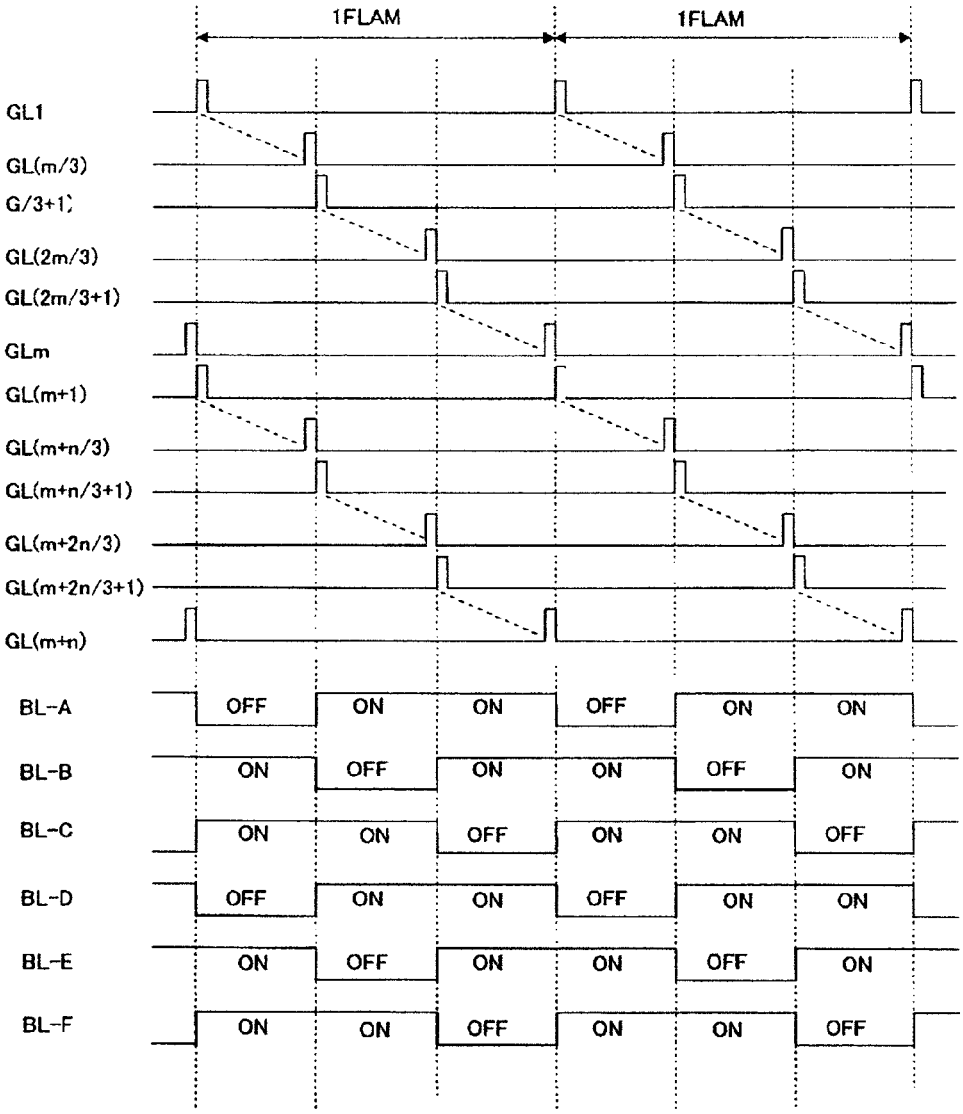
FIG. 5(*a*) is a diagram showing an example of the method for driving a liquid crystal display device according to an embodiment of the present invention.
Figure 5B:
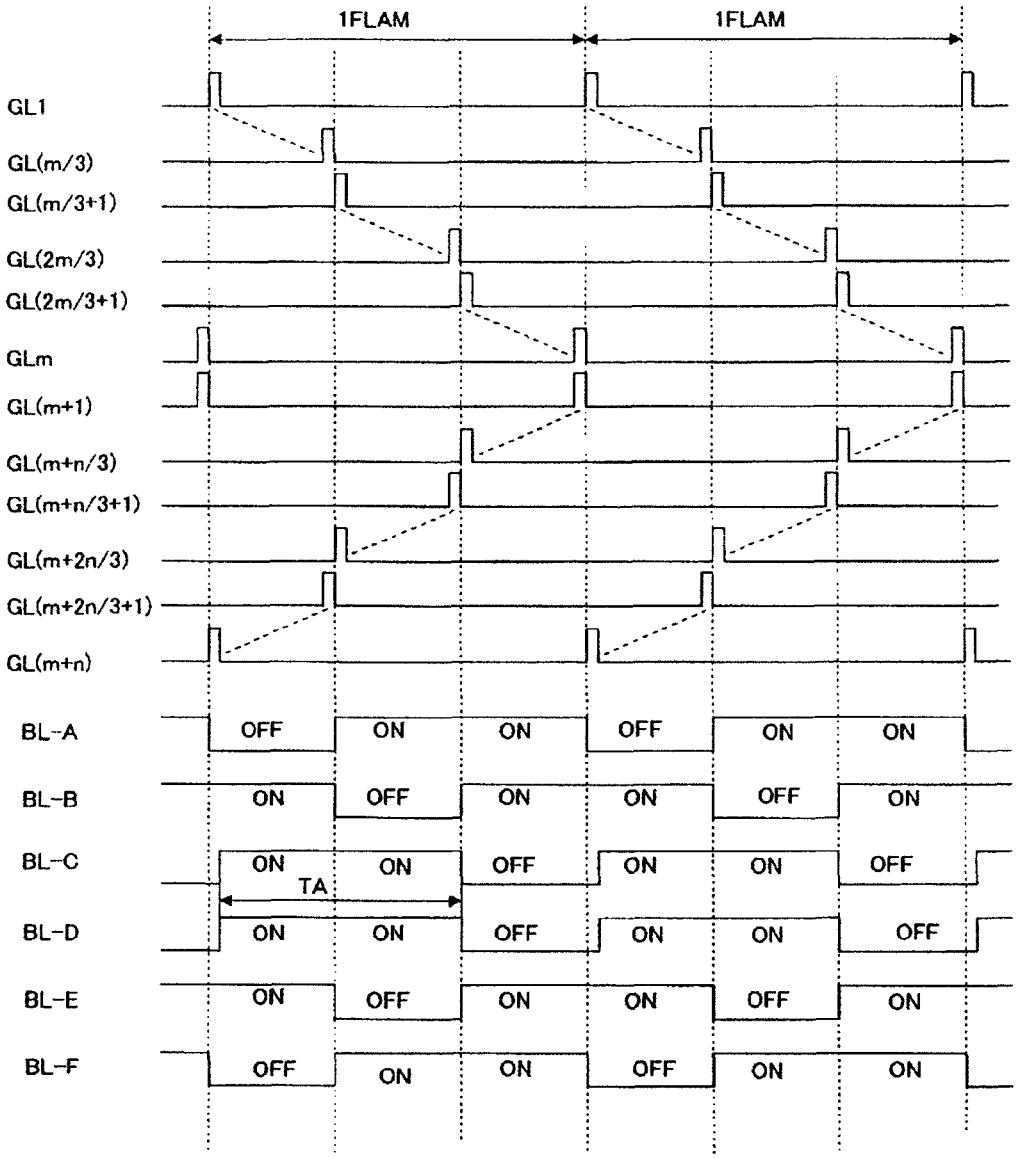
Figure 5C:
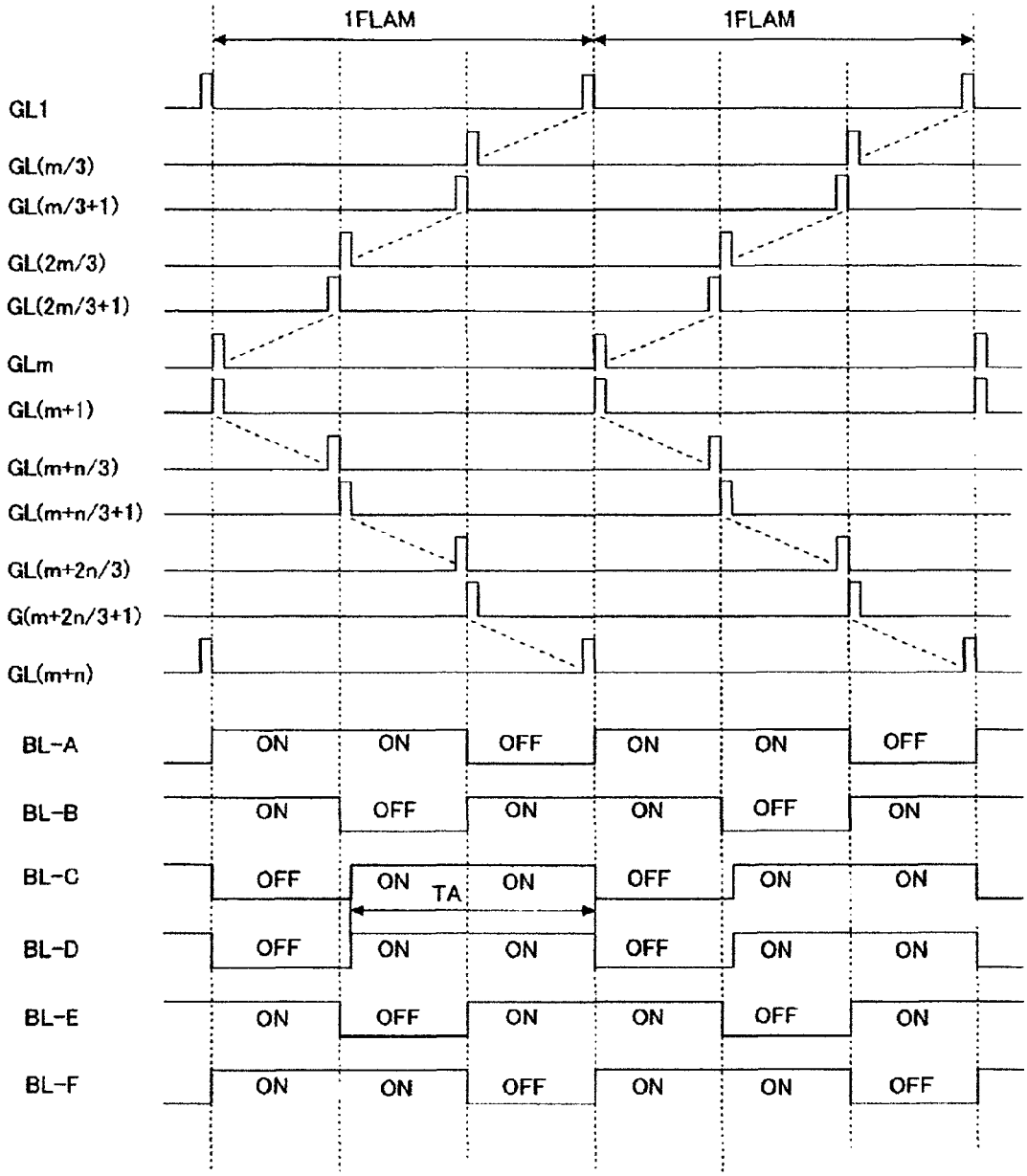

FIG. 5(*a*) is a diagram showing an example of the method for driving a liquid crystal display device according to an embodiment of the present invention.

The liquid crystal display device in the present embodiment adopts a method for simultaneously driving two screens. In accordance with the driving method in FIG. 5(*a*), the first scanning line driving circuit 20*a* supplies a selection scanning voltage to the number of first scanning lines (GL1 to GLm) one by one in the order of group A→B→C within one frame (FLAM), and at the same time, the second scanning line driving circuit 20*b* supplies a selection scanning voltage to the number of second scanning lines (GLm to GL(m+n)) one by one in the order of group D→E→F.

In addition, the inverter controlling circuit 41 turns off the cold cathode fluorescent tube (CFL) in the region corresponding to each group A to F when a selection scanning voltage is supplied to a scanning line within the groups A to F, and turns on the cold cathode fluorescent tube (CFL) in the region corresponding to each group A to F when no scanning line within the groups A to F is supplied with a selection scanning voltage.

When a selection scanning voltage is supplied to the first scanning lines (GL1 to GL(m/3)) in group A from the first scanning line driving circuit 20*a*, for example, the region (BL-A) in the backlight (BL) becomes of an OFF state, and when no first scanning line (GL1 to GL(m/3)) in group A is supplied with a selection scanning voltage from the first scanning line driving circuit 20*a*, the region (BL-A) in the backlight (BL) becomes of an ON state.

Likewise, when a selection scanning voltage is supplied to the first scanning lines (GLm to GL(m+n/3)) in group D from the second scanning line driving circuit 20*b*, for example, the region (BL-D) in the backlight (BL) becomes of an OFF state, and when no first scanning line (GLm to GL(m+n/3)) in group D is supplied with a selection scanning voltage from the second scanning line driving circuit 20*b*, the region (BL-D) in the backlight (BL) becomes of an ON state.

FIG. 5(*b*) is a diagram illustrating another example of the method for driving a liquid crystal display device according to an embodiment of the present invention.

The driving method in FIG. 5(*b*) is different from the driving method in FIG. 5(*a*) in that the first scanning line driving circuit 20*a* supplies a selection scanning voltage to the number of first scanning lines (GL1 to GLm) one by one in the order of group A→B→C within one frame (FLAM), and at the same time, the second scanning line driving circuit 20*b* supplies a selection scanning voltage to the number of second scanning lines (GLm to GL(m+n)) one by one in the order of group F→E→D.

FIG. 5(*c*) is a diagram illustrating another example of the method for driving a liquid crystal display device according to an embodiment of the present invention.

The driving method in FIG. 5(*c*) is different from the driving method in FIG. 5(*a*) in that the first scanning line driving circuit 20*a* supplies a selection scanning voltage to the number of first scanning lines (GL1 to GLm) one by one in the order of group C→B→A within one frame (FLAM), and at the same time, the second scanning line driving circuit 20*b* supplies a selection scanning voltage to the number of second scanning lines (GLm to GL(m+n)) one by one in the order of group D→E→F.

As shown in FIGS. 5(*b*) and 5(*c*), in accordance with the driving method shown in FIGS. 5(*b*) and 5(*c*), the region (BL-C) and the region (BL-D) in the backlight (BL) become of an OFF state and an ON state at the same time.

Therefore, the viewer feels like the region (BL-C) and the region (BL-D) in the backlight (BL) are brighter than other regions.

In order to prevent this, the period during which the region (BL-C) and the region (BL-D) in the backlight (BL) are turned on (period TA in FIGS. 5(*b*) and 5(*c*)) is made shorter than that in other regions (BL-A, BL-B, BL-E, BL-F).

Here, in the present embodiment, a directly-behind-the-display type backlight (BL) having light emitting diodes (LED) may be used instead of a directly-behind-the-display type backlight (BL) having a cold cathode fluorescent tube (CFL).

Figure 6:
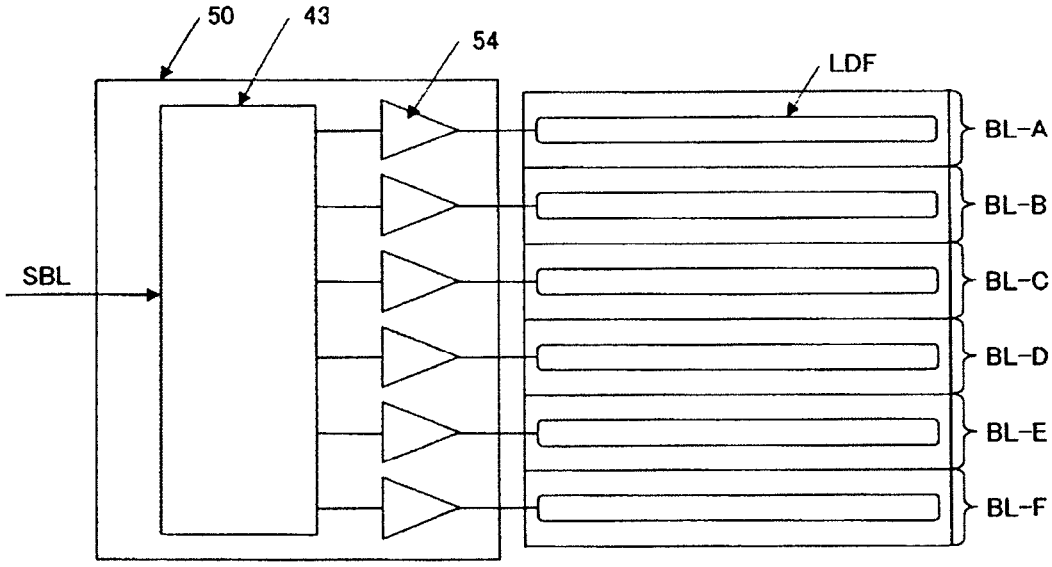
FIG. 6 is a diagram showing an example of a directly-behind-the-display type backlight having light emitting diodes.
Figure 6:
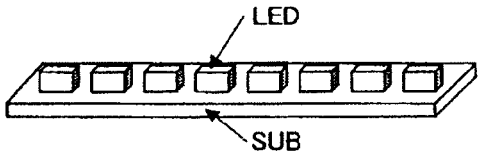

FIG. 6 shows an example of a directly-behind-the-display type backlight (BL) having light emitting diodes (LED).

In FIG. 6(*a*), the light controlling circuit 50 shown in FIG. 1 is formed of an LED driver controlling circuit 43 and an LED driver 44.

In addition, in FIG. 6(*a*), LDF is a light emitting diode column, and this light emitting diode column (LDF) is formed of a substrate (SUB) where a wire layer is formed and a number of white light emitting diodes (LED) provided on the substrate (SUB), as shown in FIG. 6(*b*).

The LED driver controlling circuit 43 individually controls and drives the respective light emitting columns (LDF) in the six regions (BL-A to BL-F) on the basis of a light controlling signal (SBL) from the display controlling circuit 10.

Thus, in the present embodiment, it becomes possible to provide a liquid crystal display device where a method for simultaneously driving two screens and a method for driving scan-back light are adopted at the same time.

Though the invention made by the present inventor is concretely described on the basis of the above described embodiments, the present invention is not limited to the above described embodiments, and various modifications are, of course, possible, in such a scope as not to deviate from the gist.

The invention claimed is:

1. A liquid crystal display device, comprising:

a liquid crystal display panel having a number of first scanning lines, a number of second scanning lines, a number of first video lines which cross said number of first scanning lines, and a number of second video lines which cross said number of second scanning lines;

a first scanning line driving circuit for supplying a scanning voltage to said number of first scanning lines;

a second scanning line driving circuit for supplying a scanning voltage to said number of second scanning lines;

at least one first video line driving circuit for supplying a video voltage to said number of first video lines; and at least one second video line driving circuit for supplying a video voltage to said number of second video lines, said first video line driving circuit and said second video line driving circuit are provided along two sides of said liquid crystal display panel which face each other;

a backlight having a number of light sources; and a light controlling circuit for controlling the turning on and off of said backlight;

wherein said number of first scanning lines are divided into M groups where M is an integer of 2 or more (M≧2), said number of second scanning lines are divided into N groups where N is an integer of 2 or more (N≧2), the region of said backlight which corresponds to said number of first scanning lines is divided into M regions and the region which corresponds to said number of second scanning lines is divided into N regions, and said light controlling circuit turns off a jth region of said backlight (1≦j≦M) when said first scanning line driving circuit is supplying a selective scanning voltage to the first scanning lines within a jth group of said number of first scanning lines, turns on the jth region of said backlight when no selective scanning voltage is supplied to the first scanning lines within the jth group, turns off a kth region of said backlight (1≦k≦N) when at least one of said second scanning line driving circuits supplies a selective scanning voltage to the second scanning lines within a kth group of said number of second scanning lines, and turns on the kth region of said backlight when no selective scanning voltage is supplied to the second scanning lines within the kth group;

wherein when the direction from said first video line driving circuit toward said second video line driving circuit is a first scanning direction and the direction from said second video line driving circuit toward said first video line driving circuit is a second scanning direction, the direction in which a selective scanning voltage is supplied from said first scanning line driving circuit to each scanning line of said number of first scanning lines in sequence is said first scanning direction, and the direction in which a selective scanning voltage is supplied from said second scanning line driving circuit to each scanning line of said number of second scanning lines in sequence is said second scanning direction;

wherein one of the M regions of said backlight and one of the N regions of said backlight are adjacent to each other;

wherein said light controlling circuit turns on both of the adjacent ones of the M and N regions of said backlight at the same time and turns off both of the adjacent ones of the M and N regions of said backlight at the same time; and wherein said light controlling circuit makes a period of turn on for both of the adjacent ones of the M and N regions of said backlight shorter than a period of turn on for the other regions of the M regions and the N regions of said backlight as a result of a delay in turn on time at the beginning of a frame for both of the adjacent ones of the M and N regions.

2. The liquid crystal display device according to claim 1, wherein said liquid crystal display panel has each of said number of first video lines and said number of second video lines is provided in such a manner as to be cut out between said number of first scanning lines and said number of second scanning lines.

3. The liquid crystal display device according to claim 1, wherein the jth region and the kth region of said backlight have at least one cold cathode fluorescent tube, and said light controlling circuit controls the turning on and off of said cold cathode fluorescent tube in the jth region and the kth region of said backlight.

4. The liquid crystal display device according to claim 1, wherein the jth region and the kth region of said backlight have at least one light emitting diode, and said light controlling circuit controls the turning on and off of said light emitting diode in the jth region and the kth region of said backlight.

5. The liquid crystal display device according to claim 1, wherein the adjacent ones of the M and N regions of the backlight are arranged at a center of said liquid crystal display panel.

* * * * *